US007188394B2

(12) United States Patent
Turvey et al.

(10) Patent No.: US 7,188,394 B2
(45) Date of Patent: Mar. 13, 2007

(54) HOLLOW RIBBED SLIDER FOR A RECLOSABLE POUCH

(75) Inventors: Robert R. Turvey, Sanford, MI (US); Bryan L. Ackerman, Freeland, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 63 days.

(21) Appl. No.: 11/047,007

(22) Filed: Jan. 31, 2005

(65) Prior Publication Data

US 2006/0168778 A1 Aug. 3, 2006

(51) Int. Cl.
*B65D 33/16* (2006.01)

(52) U.S. Cl. ..... 24/415; 24/427; 24/399; 385/64

(58) Field of Classification Search ..... 24/415, 24/427, 399; 385/64
See application file for complete search history.

(56) References Cited

U.S. PATENT DOCUMENTS

| | | | | |
|---|---|---|---|---|
| 2,495,176 | A | 1/1950 | Nissen | 24/205.14 |
| 2,514,750 | A | 7/1950 | Dobbs et al. | 150/3 |
| 3,343,235 | A | 9/1967 | Morin | 24/205.15 |
| 3,719,973 | A | 3/1973 | Bell | 24/205.15 H |
| 4,262,395 | A | 4/1981 | Kosky | 24/201 |
| D324,355 | S | 3/1992 | Takemura | D11/221 |
| 5,093,966 | A | 3/1992 | Yuki et al. | 24/429 |
| 5,956,815 | A | 9/1999 | O'Connor et al. | 24/30.5 R |
| D439,866 | S | 4/2001 | Savicki, Sr. | D11/221 |
| 6,286,191 | B2 | 9/2001 | Van Erden | 24/399 |
| 6,293,701 | B1 * | 9/2001 | Tomic | 383/64 |
| D451,378 | S | 12/2001 | Kinigakis et al. | D9/305 |
| 6,357,914 | B1 | 3/2002 | Kinigakis et al. | 383/64 |
| 6,364,530 | B1 | 4/2002 | Buchman | 383/64 |
| 6,409,384 | B1 | 6/2002 | Provan et al. | 383/5 |
| 6,450,686 | B1 * | 9/2002 | May | 383/64 |
| D466,034 | S | 11/2002 | McGuyer | D10/46.2 |
| 6,490,769 | B2 * | 12/2002 | Siegel | 24/415 |
| 6,575,625 | B2 | 6/2003 | Cappel et al. | 383/5 |
| D478,839 | S | 8/2003 | Yoneoka et al. | D11/221 |
| 6,611,996 | B2 * | 9/2003 | Blythe et al. | 24/399 |
| D482,987 | S | 12/2003 | Ritter | D11/221 |
| 6,962,440 | B2 * | 11/2005 | Fenzl et al. | 383/64 |
| 2003/0202718 | A1 | 10/2003 | Tomic | 383/64 |

* cited by examiner

*Primary Examiner*—Robert J. Sandy
*Assistant Examiner*—Marcus Menezes

(57) ABSTRACT

A slider is provided that may be oriented on a closure assembly of a reclosable pouch to open and/or close the pouch. The slider includes a top portion and at least two side walls. A channel is formed between the side walls for receiving the closure assembly of the pouch therebetween. Internal to the slider are components that generally contain functionalities to assist in opening and/or closing the closure assembly depending on the direction of movement of the slider along the closure assembly.

20 Claims, 15 Drawing Sheets

HOLLOW RIBBED SLIDER FOR A RECLOSABLE POUCH

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates to sliders for reclosable pouches, and more particularly, to a pouch having a slider capable of occluding and deoccluding a closure assembly.

2. Description of the Background of the Invention

A pouch for the storage of items typically has a closure assembly disposed at, or adjacent to, a mouth of the pouch. In some cases, a slider is provided on the closure assembly to open and close the pouch. Such closure assemblies have a slider having a top wall and two depending side walls, with a middle section of both side walls creating a concave portion. The top walls of some sliders also have a rectangular aperture disposed therein. Other types of closure assemblies have a sliding clasp having a generally U-shaped cross-section. The sliding clasp has a bight and two opposing side walls depending therefrom. The side walls also have serrations on an exterior surface thereof for assisting a user in gripping the sliding clasp. The top wall of other sliding mechanisms has a central open aperture that divides the top wall between a first portion and a second portion. The first portion generally has a flat, planar portion that extends from a periphery of the open aperture to a closing end of the slider. Similarly, the second portion generally has a flat, planar portion that extends from a periphery of the open aperture to an opening end of the slider. Each of the first and second portions has a groove. The two side walls are parallel to each other adjacent the closing end of the slider and diverge from each other adjacent the opening end. The two side walls also form convex portions in a middle section of the slider wherein the side walls in the middle portion also has vertical grooves separated from one another by lands. Other closure sliding assemblies also have ornamental designs for closing the pouch.

Other closure mechanisms have a slider that has first and second rib members integral with and extending along the exterior of a top and side walls, wherein the first rib member is disposed toward a closing end and the second rib member is disposed toward an opening end. The ribs increase the rigidity of the top and side walls to increase the force required to remove the slider from the closure mechanism.

Still other sliders with a top wall and two depending side walls have a first groove in the top wall adjacent to an opening end of the slider and a second groove adjacent a closing end of the slider. Each side wall includes a rectangular recess disposed in a middle section thereof, wherein four ribs are disposed in each of the recesses.

SUMMARY OF THE INVENTION

According to one embodiment of the present invention, a slider for a reclosable pouch includes at least one top portion with at least one top potion having a plurality of apertures. Alternatively, a plurality of apertures may be created from at least one top portion of the slider. The slider also includes side walls depending from opposite sides of the top portion for receiving a closure assembly of the reclosable pouch therebetween. The side walls extend between opening and closing ends of the slider.

According to another embodiment of the present invention, a slider for a reclosable pouch includes a top portion comprising a lattice-like arrangement of ribs, wherein a plurality of apertures is provided between the ribs. The slider also includes side walls depending from opposite sides of the top portion for receiving a closure assembly of the reclosable pouch therebetween. The side walls extend between opening and closing ends of the slider.

According to yet another embodiment of the present invention, a slider for a reclosable pouch includes a top portion comprising a lattice-like arrangement of ribs, wherein a plurality of apertures is provided between the ribs. The slider also includes side walls depending from opposite sides of the top portion for receiving a closure assembly of the reclosable pouch therebetween. The side walls extend between opening and closing ends of the slider and at least one of the side walls includes a concave portion.

According to a further embodiment of the present invention, a slider for a reclosable pouch includes a top portion comprising a lattice-like arrangement of ribs, wherein a plurality of apertures is provided between the ribs. The slider also includes side walls depending from opposite sides of the top portion for receiving a closure assembly of the reclosable pouch therebetween. The side walls extend between opening and closing ends of the slider and at least one of the side walls includes a discrete panel.

The present invention comprises these sliding closure assemblies for opening and closing a pouch, kits and combinations based thereon, and methods for the preparation and use thereof. Other aspects and advantages of the present invention will become apparent upon consideration of the following detailed description. Like reference numbers in the various drawings designate like structures in the various embodiments.

BRIEF DESCRIPTION OF THE DRAWINGS

Other aspects and advantages of the present invention will become apparent upon reading the following detailed description and upon reference to the drawings in which.

DETAILED DESCRIPTION OF THE PREFERRED EMBODIMENTS

The present invention is directed to apparatuses, methods, kits, and combinations, for opening and/or closing a reclosable pouch with a sliding closure assembly. While the present invention may be embodied in many different forms, several specific embodiments are discussed herein with the understanding that the present disclosure is to be considered only as an exemplification of the principles of the invention, and it is not intended to limit the invention to the embodiments illustrated. For example, where the invention is illustrated herein with particular reference to a reclosable pouch, it will be understood that any other reclosable pouch, such as, for example, a thermoplastic pouch, a container, a bag (for example, a paper bag, a shopping bag, a plastic bag, a handbag, or a shoulder bag), a purse, a sack (for example, a carrier sack or courier sack), a pocketbook, and/or a suitcase may, if desired, be substituted in whole or in part for the reclosable pouch in the apparatuses, methods, kits, and combinations herein described.

It has been discovered that the sliders described herein are unique assemblies exhibiting improved performance as closure mechanisms. Such slider assemblies exhibit improved functioning as sliding closure assemblies including, for example, opening and/or closing a reclosable pouch, and/or retaining the position of the slider on a closure assembly. The sliding closure assemblies of the present invention also exhibit improved ease of use, while reducing and/or minimizing the amount of material required to produce a slider assembly.

Figure 1:
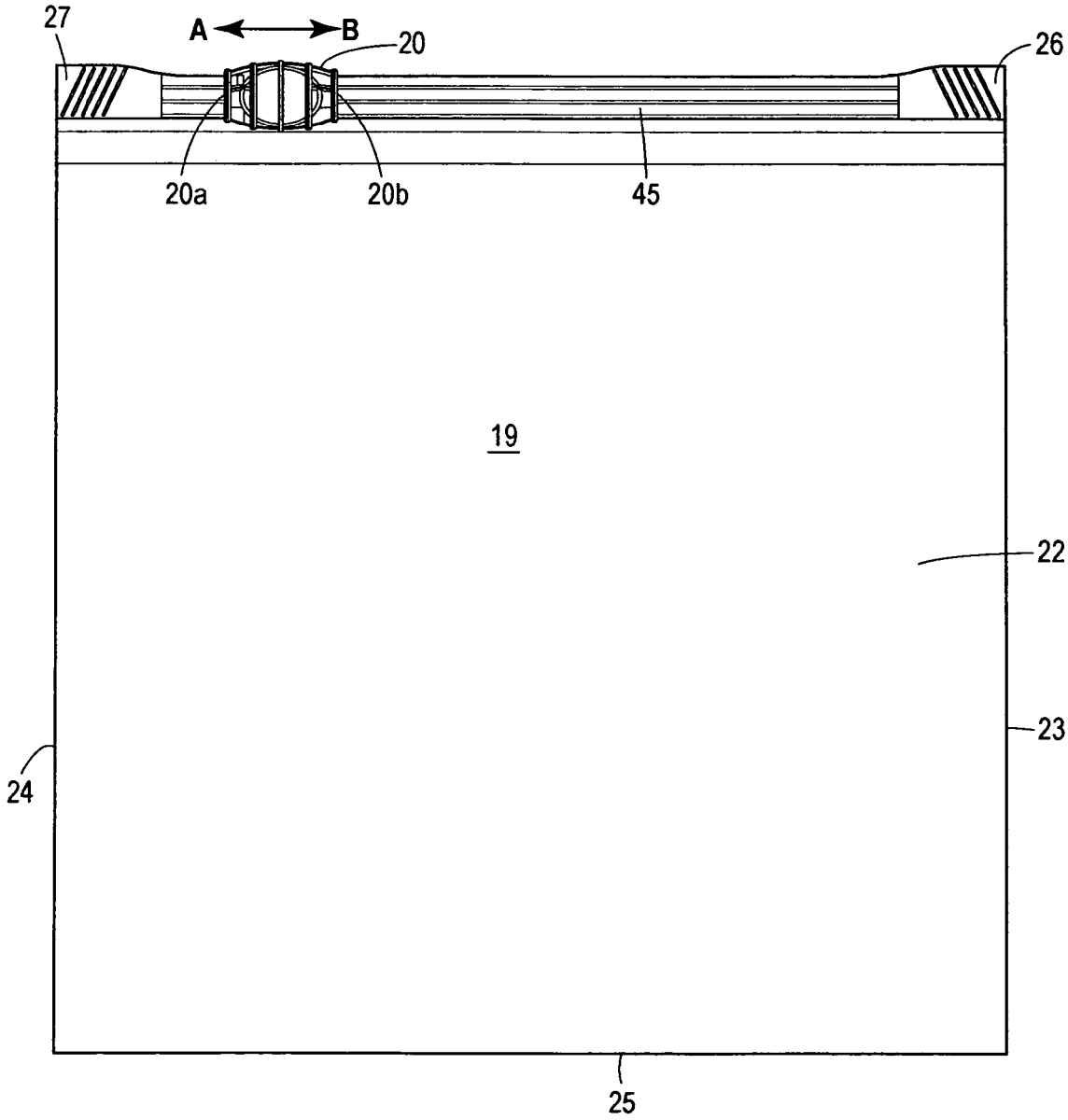
FIG. 1 is a side elevational view of one embodiment of the present invention having a closure assembly and a slider according to the present invention.

Referring now to the drawings, a slider 20 is adapted for use with a reclosable pouch 19 as seen in FIG. 1. The slider in this embodiment has a separating end 20*a* and a closing end 20*b*. The separating end 20*a* is oriented to cooperate with a closure assembly 45 to open the reclosable pouch 19, while the closing end 20*b* is oriented to cooperate with the closure assembly 45 to close the reclosable pouch. The reclosable pouch 19 includes a first pouch wall 22 and a second pouch wall (not shown), which are joined at first side portions 23 and second side portions 24 and a bottom side portion 25. The slider 20 is oriented on the closure assembly 45 having a first end stomp 26 and a second end stomp 27. Each of the end stomps 26, 27 may be formed in any suitable manner such as, for example, by ultrasonically sealing opposed walls of a mouth at the ends (not shown). The slider moves along the closure assembly 45 in a direction of an arrow A to close the closure assembly 45; or in a direction of an arrow B to open the closure assembly 45.

Figure 2:
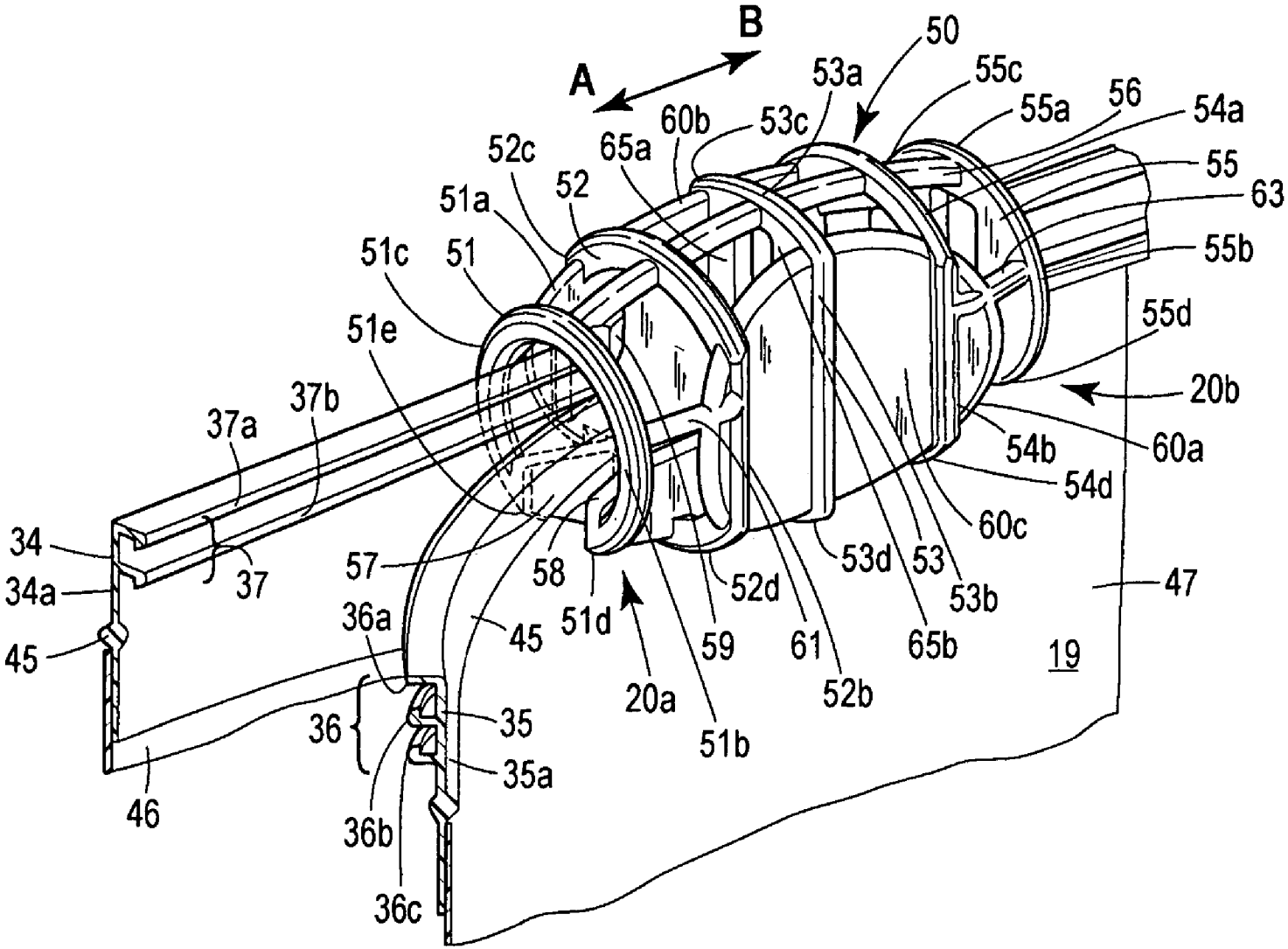
FIG. 2 is a fragmentary isometric view of a fastener track assembly and a slider of the present invention oriented on a portion of the fastener track assembly.
Figure 3:
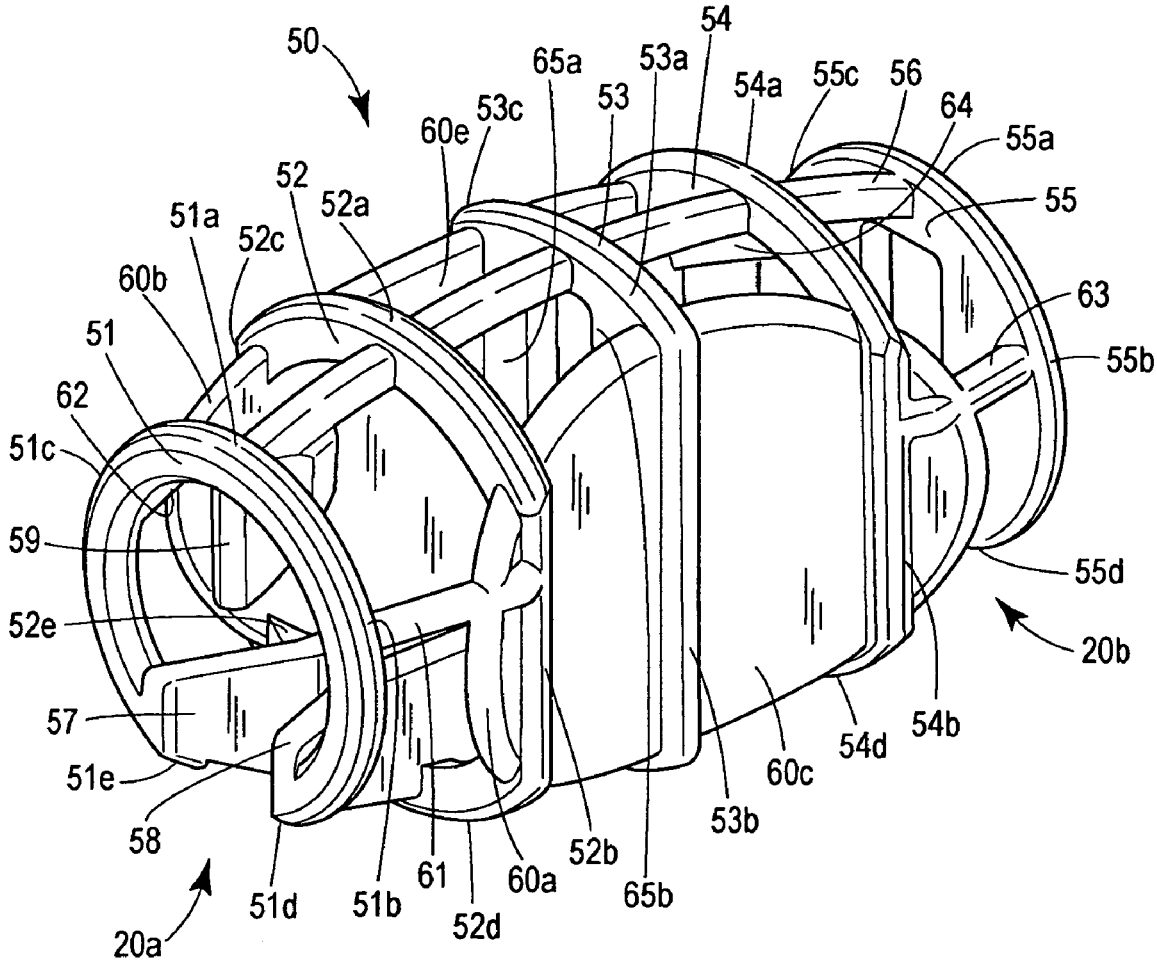
FIG. 3 is a side isometric view of one embodiment of a slider of the present invention.

Referring to FIG. 2, a slider 50 is shown oriented on a closure assembly 45 adapted for use with a reclosable pouch 19. The reclosable pouch 19 includes a first pouch wall 46 and a second pouch wall 47, with fastener strips 34, 35 depending therefrom, respectively. The fastener strips 34, 35 have an outer surface 34*a*, 35*a*, respectively, and other structures associated therewith, which will be discussed in detail below, that cooperate with fastener mechanisms 36, 37 to allow same to be received within the slider 50 as the slider 50 is moved along a length of the closure assembly 45 in a direction of an arrow A or B.

Figure 4:
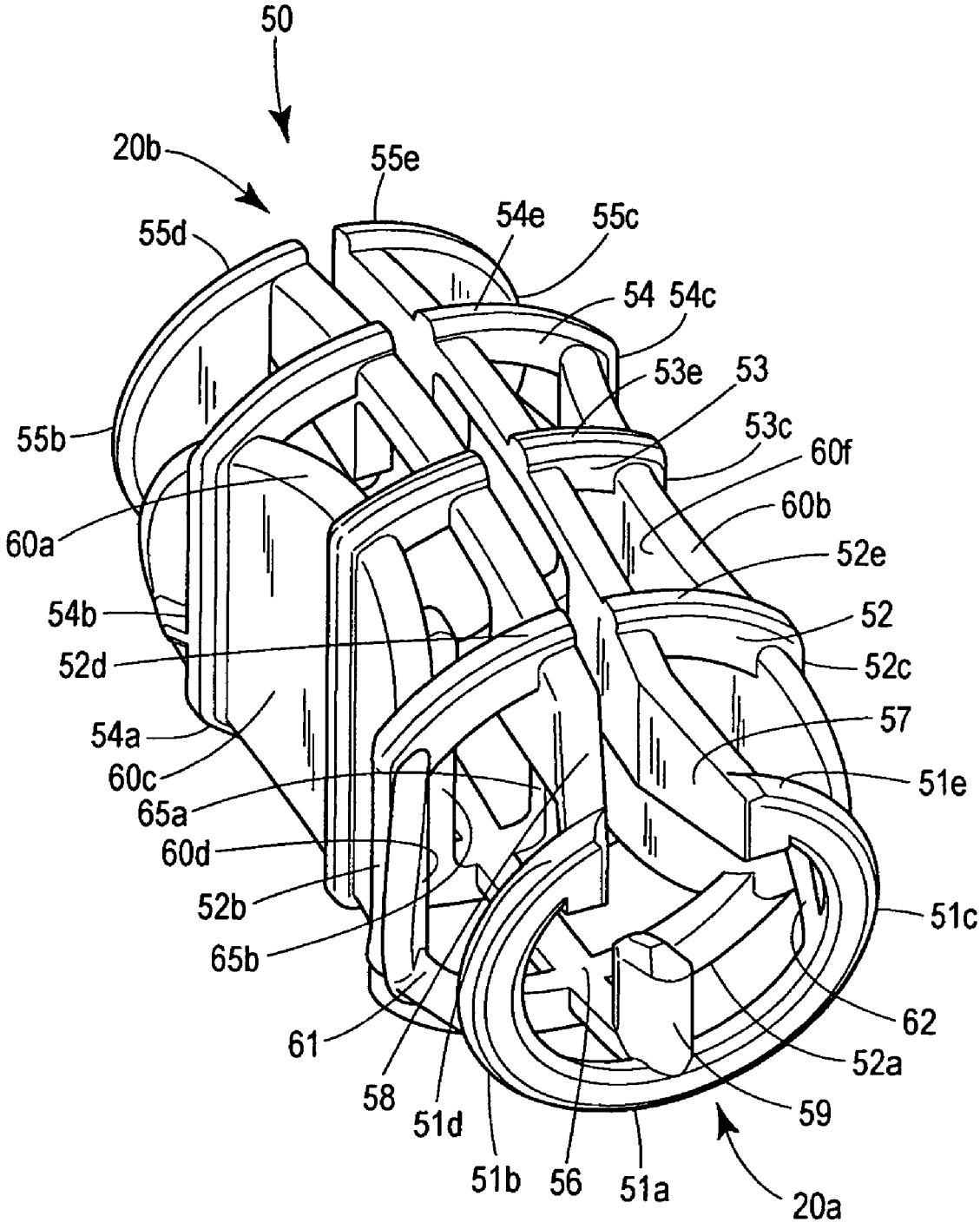
FIG. 4 is a bottom isometric view of one embodiment of a slider of the present invention.

Referring to FIGS. 2–7, a slider 50 is depicted with five ribs 51, 52, 53, 54, 55. The slider has a separating end 20*a* and a closing end 20*b*, and a central elongate rib 56 running between a separating end 20*a* and a closing end 20*b*. A central rib 53 perpendicular to a longitudinal axis of the slider 50 has a top portion 53*a*, side portions 53*b*, 53*c* depending therefrom, and bottom portions 53*d*, 53*e* depending from their respective side portions. Moving from the central rib 53 toward the separating end 20*a*, rib 52 has a top portion 52*a*, side portions 52*b*, 52*c* depending therefrom, and bottom portions 52*d*, 52*e* depending from their respective side portions. Moving further toward the separating end 20*a*, a semicircular rib 51 has a top portion 51*a*, side portions 51*b*, 51*c*, and bottom portion 51*d*, 51*e*, and is disposed at the end of the central elongate rib 56 perpendicular to the longitudinal axis of the slider 50 and when oriented on a reclosable pouch 19 circumscribes a closure assembly 45 of the reclosable pouch. Moving from the central rib 52 toward the closing end 20*b*, rib 54 has a top portion 54*a*, side portions 54*b*, 54*c* depending therefrom, and bottom portions 54*d*, 54*e* depending from their respective side portions. Moving further toward the closing end 20*b*, a semicircular rib 55 has a top portion 55*a*, side portions 55*b*, 55*c* depending therefrom, and bottom portions 55*d*, 55*e* depending from their respective side portions, and is disposed at the end of the central elongate rib 56 perpendicular to the longitudinal axis of the slider 50 and when oriented on the reclosable pouch circumscribes the closure assembly 45 of the pouch. Running along the bottom of the slider 50 depending from rib bottom portions 51*d*, 51*e*, 52*d*, 52*e*, 53*d*, 53*e*, 54*d*, 54*e*, 55*d*, 55*e* are pinching or guide member elements 57, 58 that form a channel between the ribs 51, 52, 53, 54, 55 of the slider. A separating finger 59 depends from the top portion 51*a* of rib 51 and the central elongate rib 56. Concave portions or inverted U-shaped side members 60*a*, 60*b* extends respectively downward from top portions 52*a*, 53*a*, 54*a* of the ribs 52, 53, 54, and depends from their respective rib side portions 52*b*, 53*c*, 53*b*, 53*c*, 54*b*, 54*c*. Side support members 61, 62 running from side portions 51*b*, 51*c*, respectively, of the semicircular rib 51, connect the semicircular rib 51 to the concave portions or inverted U-shaped side members 60*a*, 60*b* and the side portions 52*b*, 52*c* of rib 52. Side support members 63, 64 running from the side portions 55*b*, 55*c*, respectively, of the semicircular rib 55, connects the semicircular rib 55 to the concave portions or U-shaped side members 60*a*, 60*b* having exterior portions 60*c*, 60*f*, respectively, and interior portions 60*d*, 60*e*, respectively, and the side portions 54*b*, 54*c* of rib 54. Closing elements 65*a*, 65*b* are located on the side portions 53*b*, 53*c* of the central rib 53 and run perpendicular to the longitudinal axis of the slider 50. Closing elements 65*a*, 65*b* may have at least one generally rounded edge as shown in FIG. 4 to inhibit tearing of a closure assembly (not shown) as the slider 50 moves along the closure assembly.

As shown in FIG. 2, the closing elements 65*a*, 65*b* internal to the slider 50 further interact with the closure assembly 45 to further interlock the closure assembly 45. A fastener strip 35 has a fastener mechanism 36 having a first guide strip 36*a* that interacts with a first closure member 37*a* of a fastener mechanism 37. At the end of the first closure member 37*a* is a hook or catch that interacts and/or engages with a second closure member 36*b*, which also has a hook or catch projecting from the base of the fastener strip 35. Second closure member 36*c* interacts or engages with third closure member 37*b*, both having a hook or catch projecting from their respective bases. Guide strip 36*a* aides in aligning fastener strips 34, 35 and associated fastener mechanisms 36, 37 during closure of the pouch as the slider 50 moves to a closed position in an arrow direction A. Guide strip 36*a* also assists in holding the closure assembly 45 in a closed position when the slider is stationary. A semicircular rib 51 at the closing end 20*a* of the slider 50 also includes a separating finger 59 that depends from a top portion 51*a* of the semicircular rib 51 between side walls 51*b*, 51*c* and the fastener strips 34, 35. The separating finger 59 is positioned adjacent the separating end 20*a* and extends downward between a portion of the fastener mechanism 36, 37 and the side walls 51*b*, 51*c*.

As shown in FIG. 2, the separating finger 59 does not need to extend all the way through past all the fastener mechanisms 36, 37. Rather, the separating finger 59 may extend partially through the fastener mechanisms 36, 37, which is sufficient to interrupt or disengage the closure of the fastening strips 34, 35. However, it is contemplated that the separating finger 59 may be positioned at any interior position, for example, more toward the closing end 20*b* and/or farther into the fastener mechanisms 36, 37 than is shown in FIGS. 2–7, as long as the separating finger 59 is capable of disrupting the fastener mechanisms 36, 37 of the closure assembly 45 and allowing the closure assembly to open and/or disengage.

With reference again to FIG. 2, it may also be seen that the slider 50 is movable along a length of the closure assembly 45 between an open position and a closed position. When the slider 50 is moved toward an open position in the arrow direction B, the closing end 20*b* of the slider 50 leads, and the separating end 20*a* of the slider 50 trails, so that the separating finger 59 disengages the fastener mechanisms 36, 37. Therefore, when the slider 50 is in an open position, the fastener strips 34, 35 are disengaged throughout substantially their entire length and the closing end 20*b* of the slider 50 is adjacent to an end stomp (not shown). When the slider 50 is moved toward a closed position in the arrow direction A, the separating end 20*a* leads and the closing end 20*b* trails, so that closing elements 65*a*, 65*a* squeeze or pinch the closure mechanism 45 together into engagement. In this instance, when the slider 50 is in a closed position, the fastener strips 34, 35 are interlocked throughout substantially their entire length and the separating end 20*a* of the slider is adjacent to an end stomp (not shown).

Figure 5:
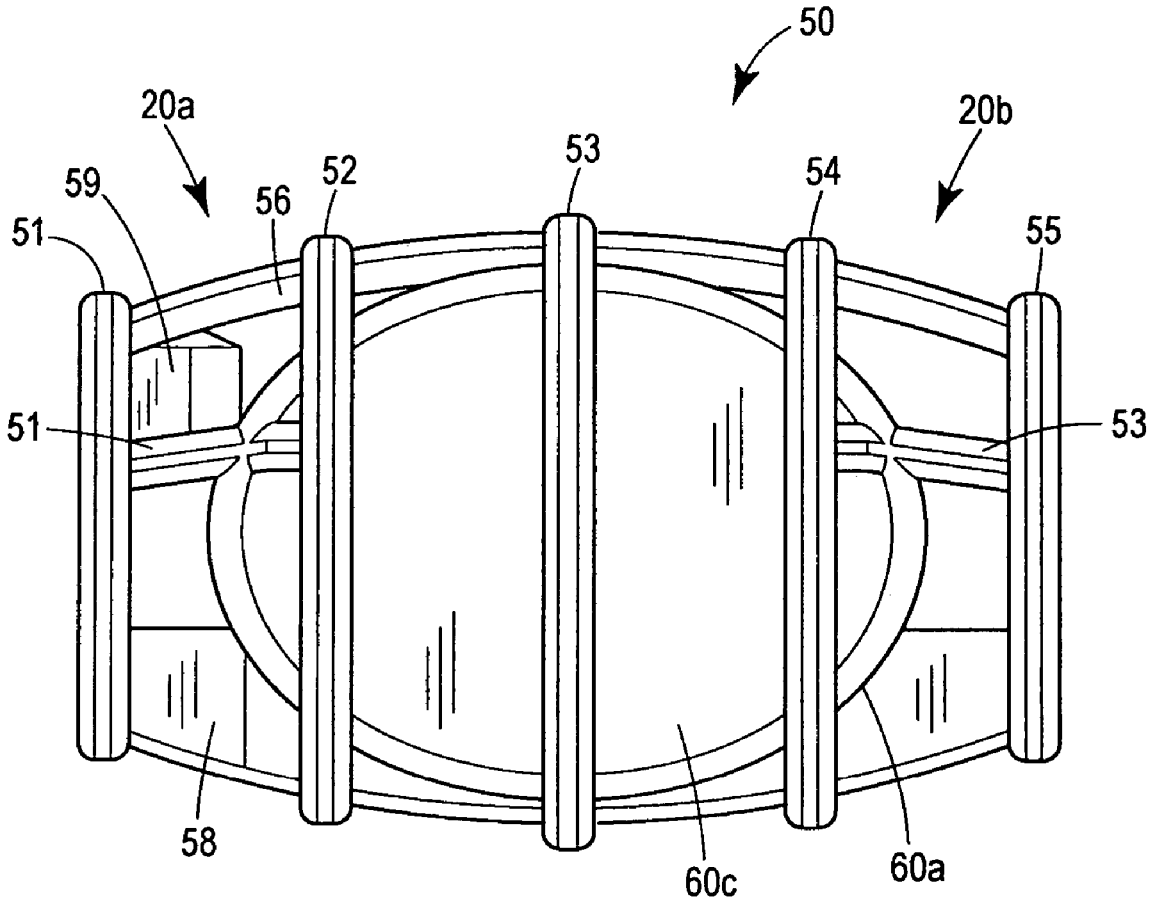
FIG. 5 is a side elevational view of one embodiment of a slider of the present invention.

In a side view of the slider 50, FIG. 5 shows the slider 50 with the separating end 20*a*, the closing end 20*b*, and the central elongate rib 56 running between the separating end 20*a* and the closing end 20*b*. The central elongate rib 56 connects the ribs 51, 52, 53, 54, 55 of the slider 50. The side support member 61 connects the semicircular rib 51 to the concave portion or U-shaped side member 60*b* and the rib 52. The side support member 63 connects the semicircular rib 55 to the concave portion or U-shaped member 60*b* and the rib 54. The concave portion or U-shaped side member 60*a* depend from ribs 51, 52, 53, 54, 55. The pinching or guide member element 58 runs along the length of the slider 50 from the semicircular rib 51 at the separating end 20*a* to the semicircular rib 55 at the closing end.

Figure 6:
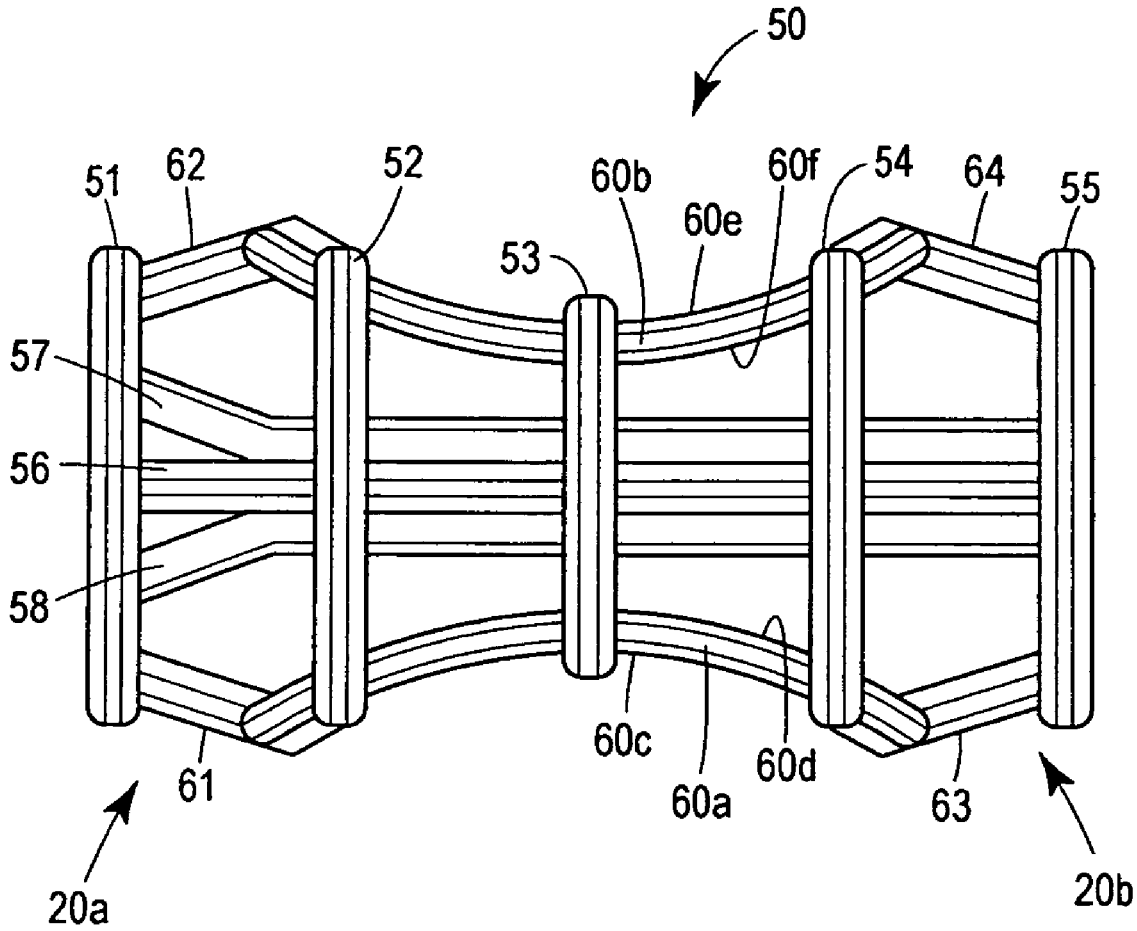
FIG. 6 is a plan view of one embodiment of a slider of the present invention.
Figure 7:
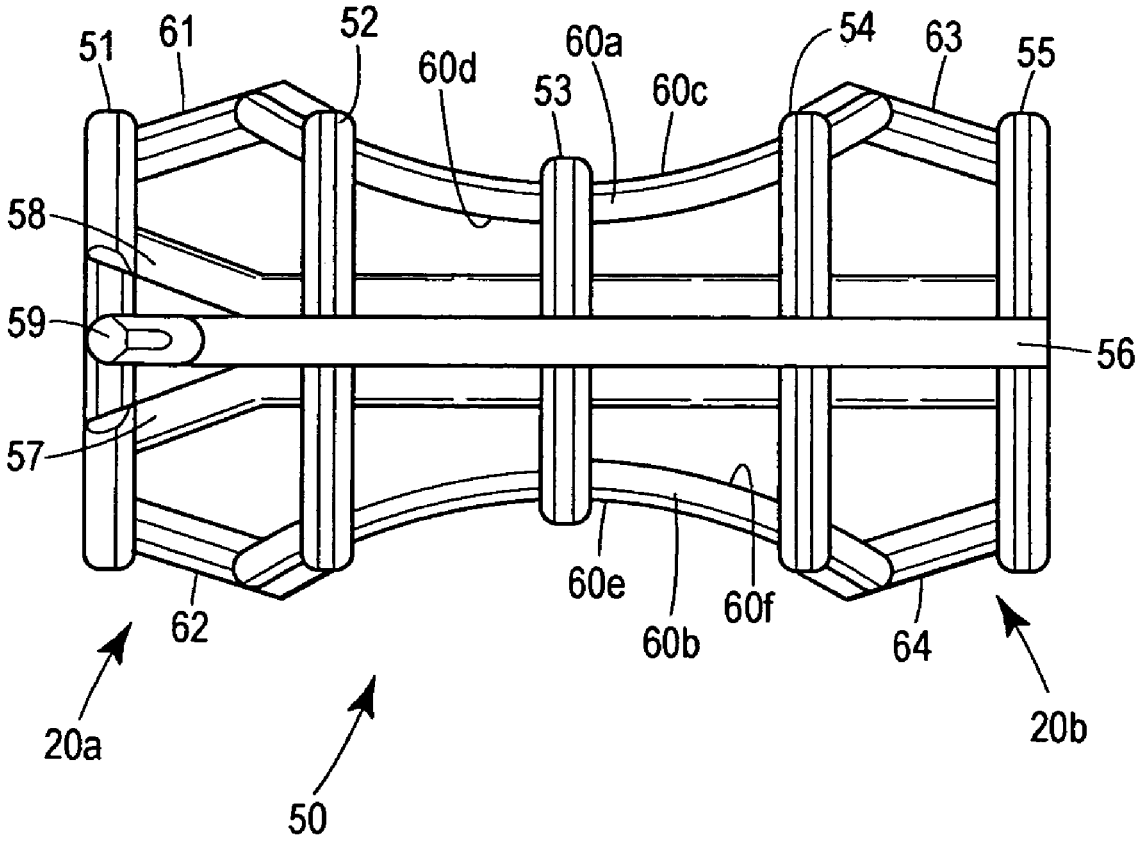
FIG. 7 is a bottom elevational view of one embodiment of a slider of the present invention.
Figure 8:
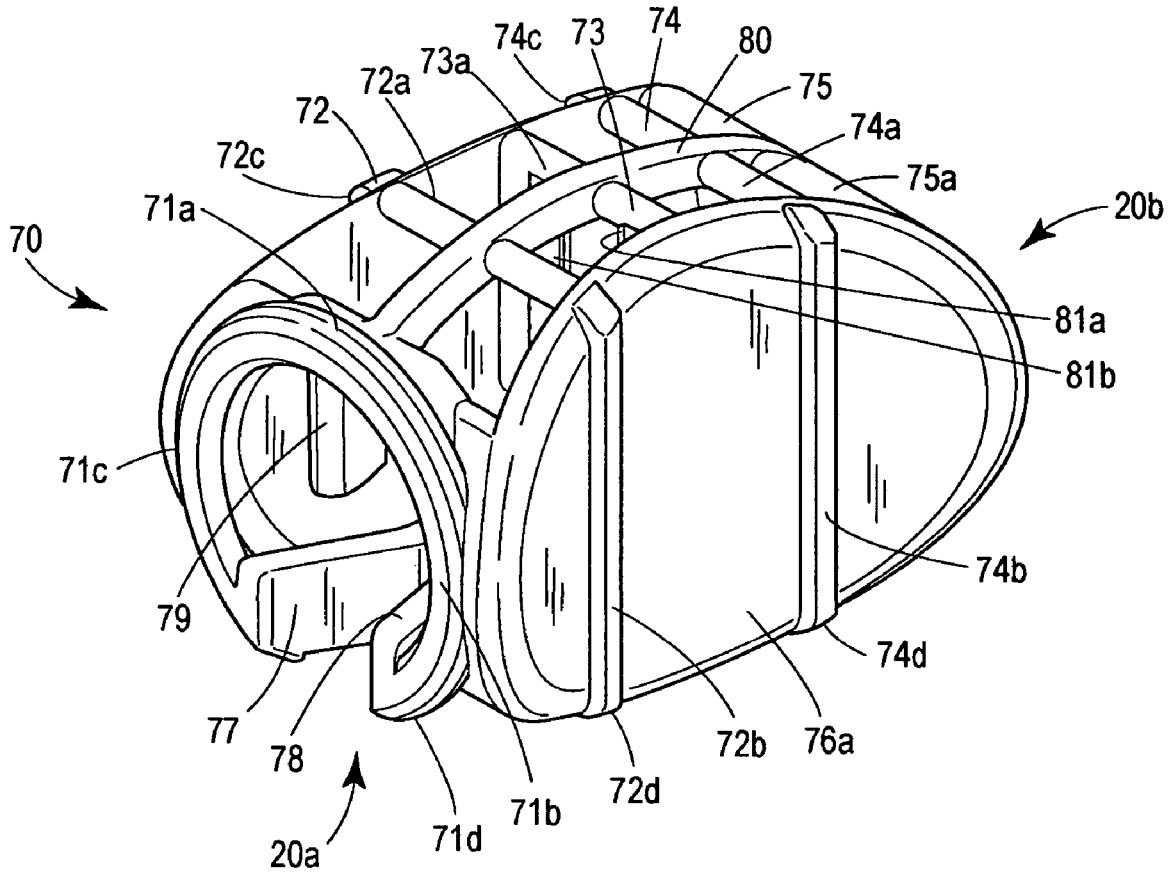
FIG. 8 is a top isometric view of one embodiment of a slider of the present invention.
Figure 9:
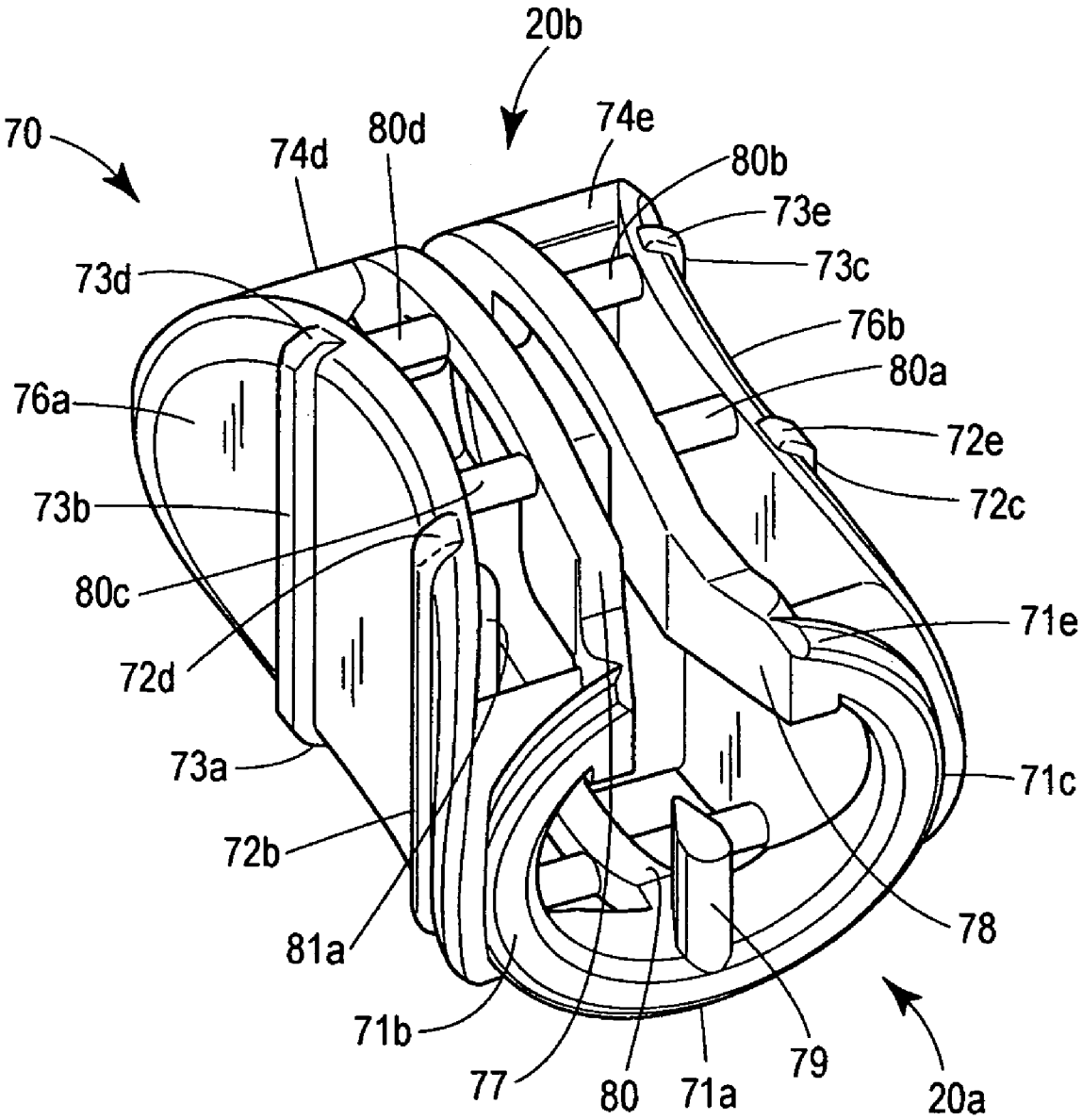
FIG. 9 is a bottom isometric view of one embodiment of a slider to the present invention.
Figure 10:
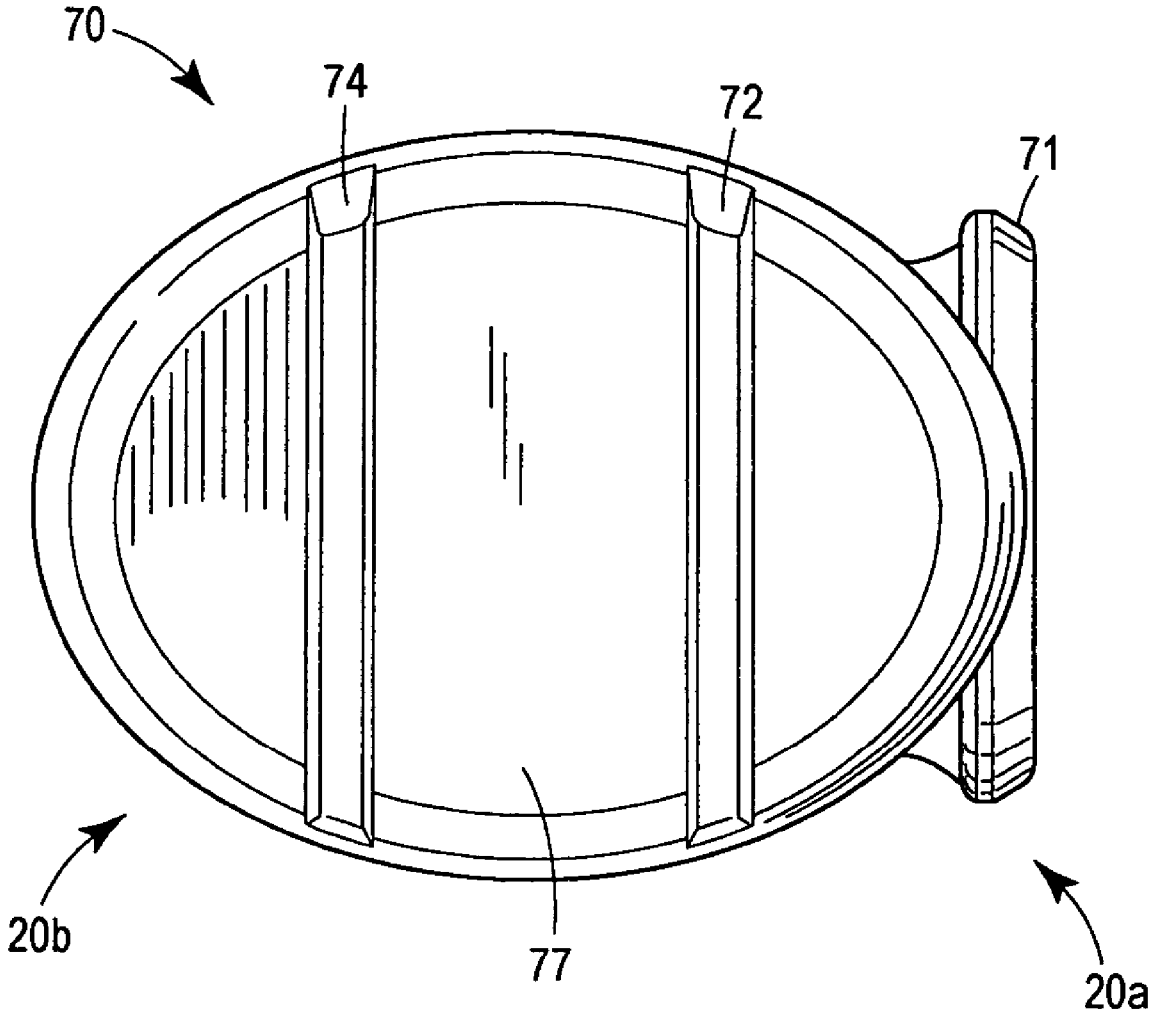
FIG. 10 is a side elevational view of one embodiment of a slider of the present invention.
Figure 11:
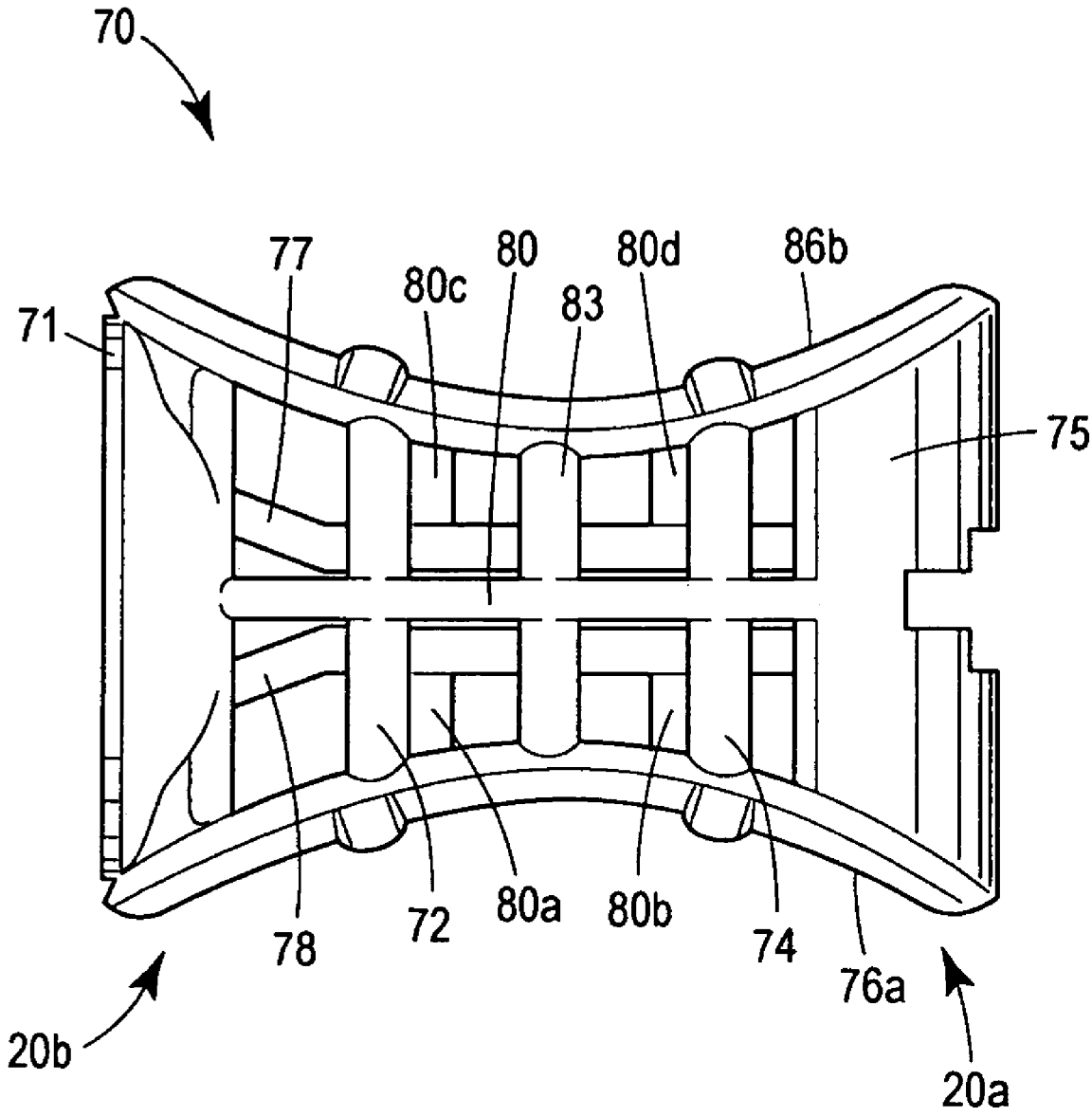
FIG. 11 is a plan view of one embodiment of a slider of the present invention.

As shown in FIGS. 6–7, the slider 50 has the separating end 20*a*, the closing end 20*b*, and the central elongate rib 56 running between the separating end 20*a* and the closing end 20*b*. The central elongate rib 56 connects the ribs 51, 52, 53, 54, 55 of the slider 50. The side support members 61, 62 connect the semicircular rib 51 to the concave portions or U-shaped side members 60*a*, 60*b*, respectively, and the rib 52. The side support members 63, 64 connect the semicircular rib 55 to the concave portion or U-shaped side member 60*a*, 60*b*, respectively, and the rib 54. The concave portions or U-shaped side members 60*a*, 60*b* depend from ribs 52, 53, 54. The pinching or guide member elements 57, 58 forms a channel between the ribs 51, 52, 53, 54, 55 and run the length of the slider 50 from the semicircular rib 51 at the separating end 20*a* to the semicircular rib 55 at the closing end. Referring to FIG. 7, the separating finger 59 depends from the rib 51 and the central elongate rib 56.

Figure 12:
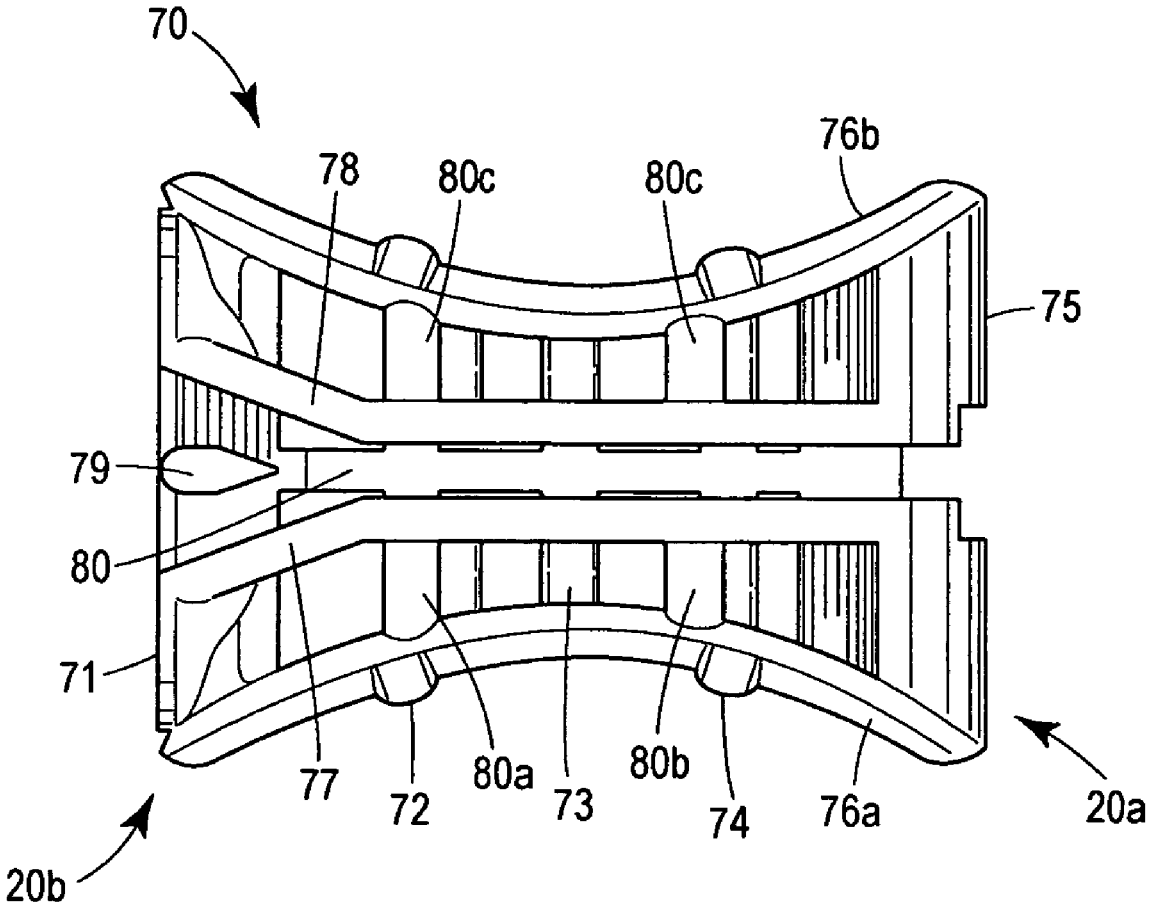
FIG. 12 is a bottom elevational view of one embodiment of a slider of the present invention.
Figure 13:
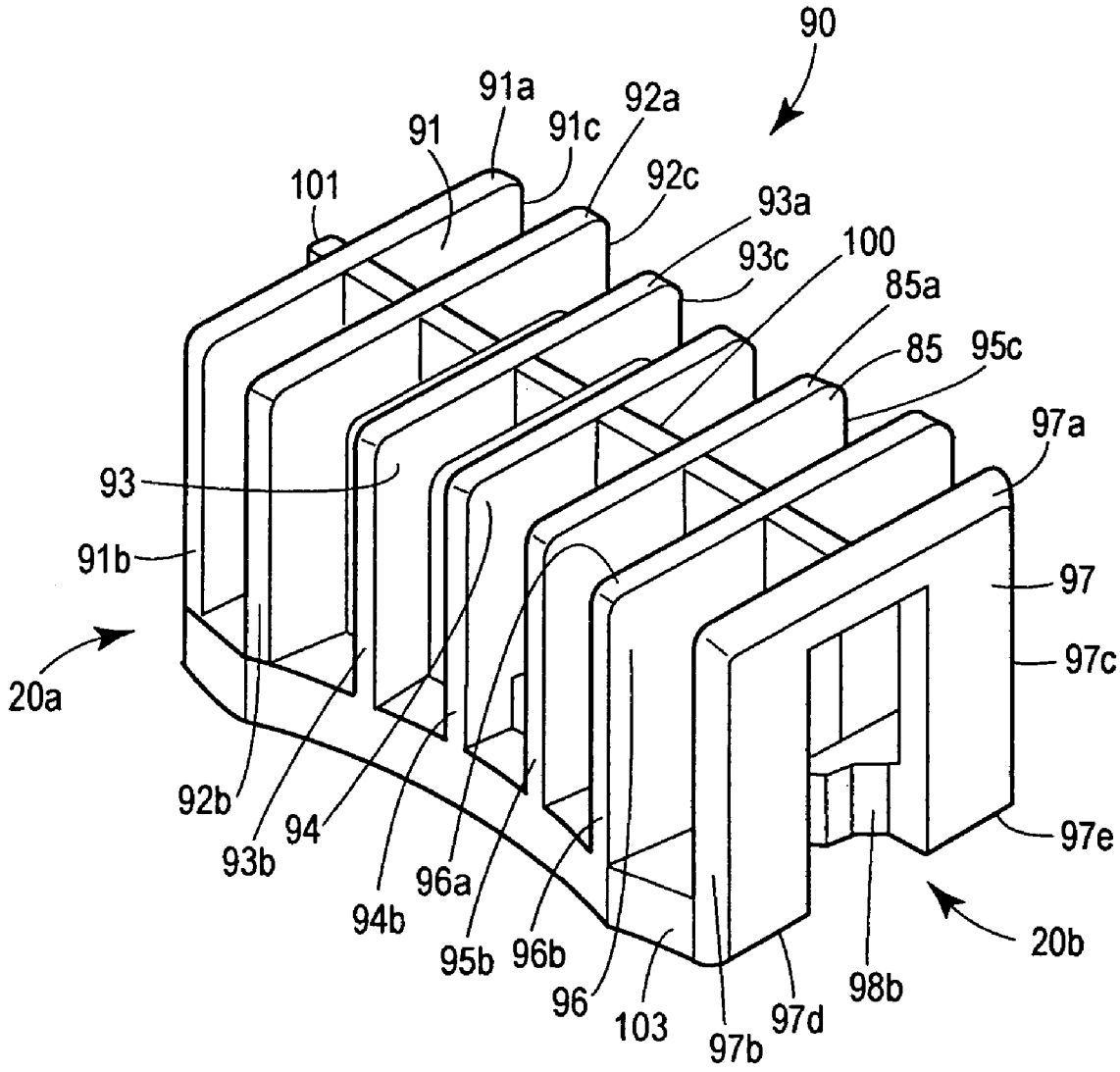
FIG. 13 is a side isometric view of one embodiment of a slider of the present invention.
Figure 14:
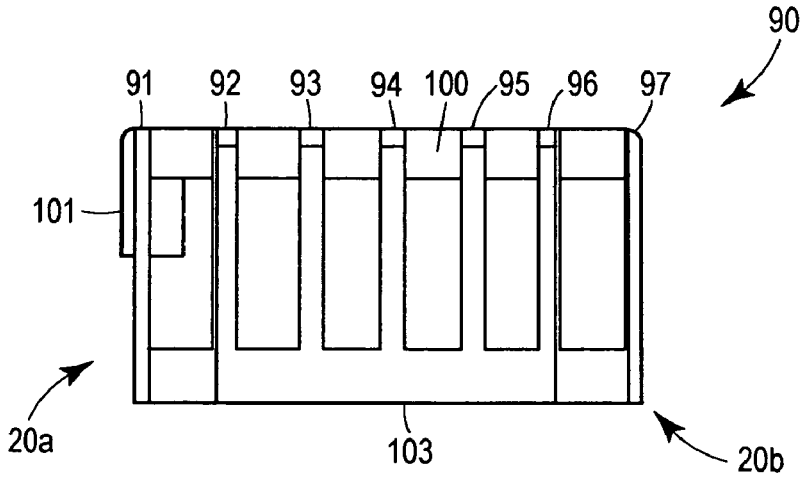
FIG. 14 is a side elevational view of one embodiment of a slider of the present invention.
Figure 15:
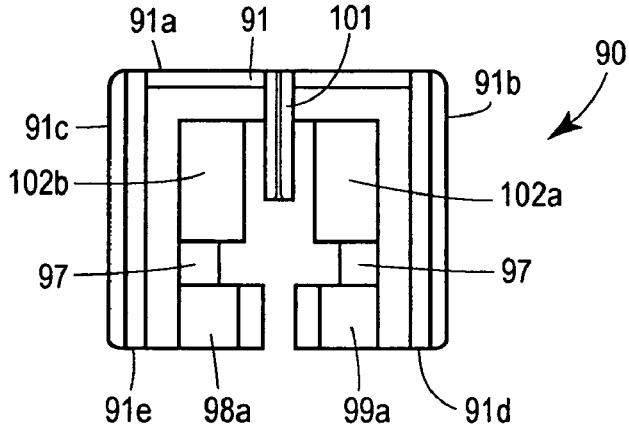
FIG. 15 is a front elevational view of one embodiment of a slider of the present invention.
Figure 16:
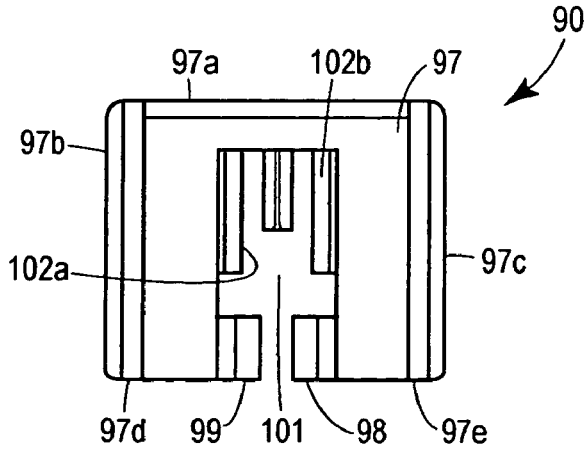
FIG. 16 is a rear elevational view of one embodiment of a slider of the present invention.
Figure 17:
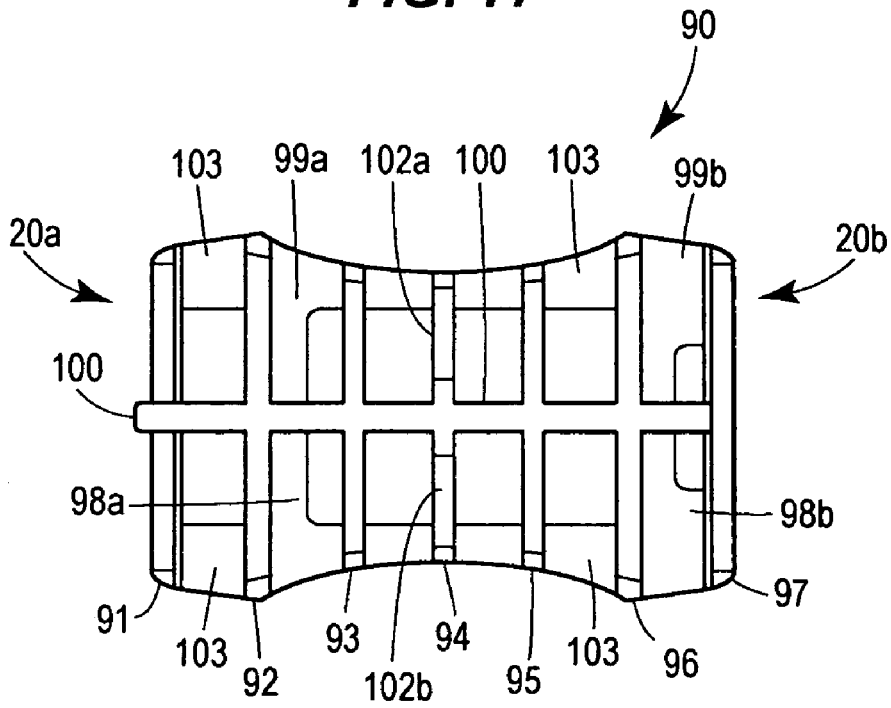
FIG. 17 a plan view of one embodiment of a slider of the present invention.
Figure 18:
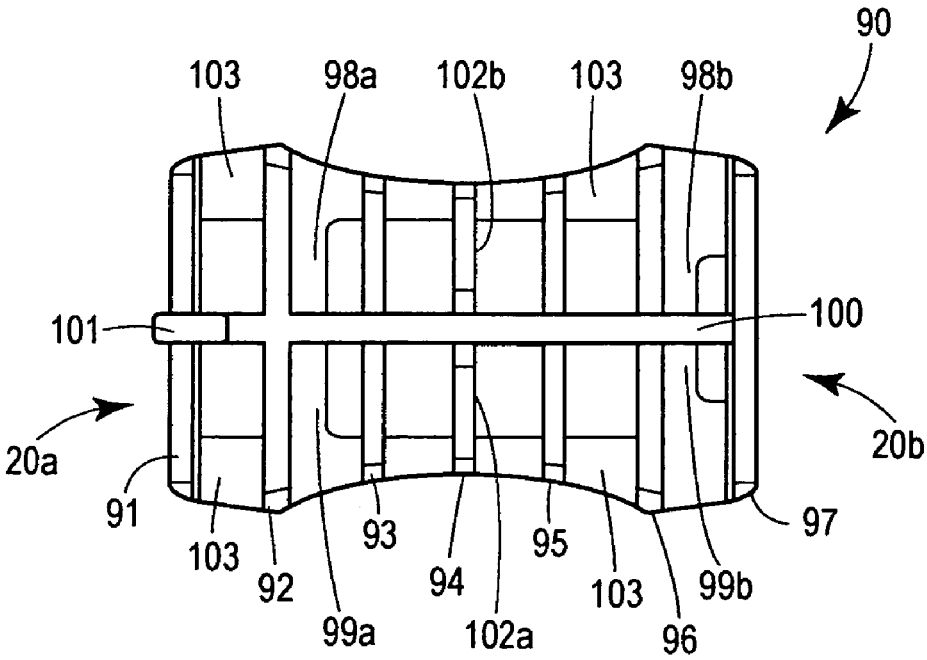
FIG. 18 is a bottom elevational view of one embodiment of a slider of the present invention.

Referring now to FIGS. 8–12, a slider 70 is depicted with five ribs 71, 72, 73, 74, 75. The slider has a separating end 20*a* and a closing end 20*b*, and a central elongate rib 80 running between the separating end 20*a* and the closing end 20*b*. A central rib 73 perpendicular to the longitudinal axis of the slider 70 has a top portion 73*a*, side portions 73*b*, 73*c* depending therefrom and bottom portions 73*d*, 73*e*. Moving from the central rib 73 toward the separating end 20*a*, rib 72 has a top portion 72*a*, side portions 72*b*, 72*c* depending therefrom and bottom portions 72*d*, 72*e* depending from their respective side portions. Moving further toward the separating end 20*a*, semicircular rib 71 has a top portion 71*a*, side portions 71*b*, 71*c*, and bottom portion 71*d*, 71*e*, and is disposed at the end of the central elongate rib 80 perpendicular to a longitudinal axis of the slider 70 and when oriented on a reclosable pouch (not shown) circumscribes the closure assembly (not shown) of the reclosable pouch. Moving from the central rib 73 toward the closing end 20*b*, rib 74 has a top portion 74*a*, side portions 74*b*, 74*c* depending therefrom and bottom portions 74*d*, 74*e* depending from their respective side portions. Moving toward the closing end 20*b*, rib 75 has a top portion 75*a*, side portions 75*b*, 75*c* depending therefrom and bottom portions 75*d*, 75*e* depending from their respective side portions, and is disposed at the end of the central elongate rib 80. Running along the bottom of the slider 70 depending from the rib bottom portions 71*d*, 71*e*, 75*d*, 75*e* are pinching or guide member elements 77, 78 that form a channel between the ribs 71, 75 of the slider. In a bottom view, FIG. 9, the pinching or guide member elements 77, 78 may be seen having a wider opening at the separating end 20*a* as compared to the closing end 20*b*. This wider opening in one aspect of the present invention facilitates engagement of a closure assembly (not shown) with the slider 70. The wider opening, for example, assists in receiving and/or aligning a closure assembly as the slider 70 moves along the closure assembly into a closed position. A separating finger 79 depends from the top portion 71*a* of rib 71. Discrete side members 76*a*, 76*b* extends downward from the respective top portions 71*a*, 72*a*, 73*a*, 74*a*, 75*a* of ribs 71, 72, 73, 74, 75 and depends from the respective rib side portions 71*b*, 71*c*, 72*b*, 73*c*, 73*b*, 73*c*, 74*b*, 74*c*, 75*b*, 75*c*. Side support members 80*a*, 80*b*, 80*c*, 80*d* attach the discrete side members 76*a*, 76*b* to pinching or guide member elements 77, 78. Closing elements 81*a*, 81*b* are located on the sides 75*b*, 73*c* of the central rib 73 and run perpendicular to the longitudinal axis of the slider 70. Referring to FIG. 12, the separating finger 79 depends from rib 71 and central elongate rib 80.

Referring now to FIGS. 13–18, a slider 90 of the present invention is depicted with seven ribs 91, 92, 93, 94, 95, 96, 97 and a bottom portion 103. The slider has a separating end 20*a* and a closing end 20*b*, and a central elongate rib 100 running between the separating end 20*a* and the closing end 20*b*. The central rib 94 perpendicular to a longitudinal axis of the slider 90 and has a top portion 94*a*, side portions 94*b*, 94*c* depending therefrom and attached to bottom portion 103. Moving from the central rib 94 toward the separating end 20*a*, ribs 91, 92, 93 have a top portion 91*a*, 92*a*, 93*a*, respectively, and side portions 91*b*, 91*c*, 92*b*, 92*c*, 93*b*, 93*c*, respectively, depending therefrom and attached respectively to the bottom portion 103. Moving from the central rib 94 toward the closing end 20*b*, ribs 95, 96 have a top portion 95*a*, 96*a*, respectively, side portions 95*b*, 95*c*, 96*b*, 96*c*, respectively, depending therefrom and attached respectively to the bottom portion 103. Moving to the closing end 20*b*, rib 97 comprising a top portion 97*a*, side portions 97*b*, 97*c* depending therefrom and bottom portions 97*d*, 97*e* depending from their respective side portions, and is disposed at the end of the central elongate rib 100. Running along the bottom of the slider 100 depending from the ribs 92, 93, 96, 97 are pinching or guide member elements 98*a*, 98*b*, 99*a*, 99*b*, respectively that form a channel between the ribs 92, 93, 96, 97 of the slider 90. A separating finger 101 depends from the top portion 91*a* of rib 91. Closing elements 102*a*, 102*b* are located on the sides 94*b*, 94*c* of the central rib 94 and run perpendicular to the longitudinal axis of the slider 100.

In other embodiments of the present invention, a slider provided for movement on a closure assembly between an opened and closed position includes at least one top portion and at least two side walls, with each side wall having an interior and exterior surface. A channel is formed between at least two interior side surfaces of the side walls for receiving the closure assembly of the pouch therebetween. In one embodiment, at least one portion of the side walls extends from an area at or near an opening end of the slider to an area at or near a closing end of the slider. The opening end of the slider generally contains functionalities associated with it that generally assist in opening the closure assembly by, for example, disengaging a closure mechanism of the closure assembly as the slider moves from a closed position to an opened position; while the closing end of the slider generally contains functionalities associated with it that generally assist in closing the closure assembly by, for example, pinching the closure assembly into an interlocked position as the slider moves from an opened to closed position.

In other embodiments, a slider has at least one rib and/or lattice, each having at least one top portion and at least two side walls to form a channel between the side walls for receiving a closure assembly of the pouch therebetween. In some embodiments, at least one concave portion or U-shaped side member may be integral and/or disposed on at least one interior and/or exterior side wall or portion of the slider. Such concave portions or U-shaped side members may have at least one side and/or portion interior to the slider and/or at least one side and/or portion exterior to the slider. These concave portions or U-shaped side members in one embodiment may be oriented on the slider to assist a user in gripping and/or operating the slider. In further embodiments of the present invention, at least one guide member extends inwardly from at least one inner wall and/or at least one interior portion (for example, a side member) of the of the slider to assist in receiving and/or aligning the closure assembly as the slider moves along the closure assembly. Such guide members may also be used to engage the closure assembly to prevent removal of the slider therefrom. At least one foot extending inwardly from at least one side wall of the slider may also be used to engage the closure assembly to prevent removal of the slider therefrom. Additionally, at least one closing member may extend inwardly from at least one inner wall and/or at least one interior portion (for example, a side member) of the slider to assist in closing the closure assembly as the slider is moved from an opened position to a closed position.

In other embodiments of the present invention, the apparatuses, methods, kits, and combinations are directed to assisting a user in operating a closure mechanism disposed on a reclosable pouch. For example, in one embodiment at least one exterior side wall of the slider is in a shape to assist a user in gripping the slider. Such shapes include, for example, a concave shape (for example, U-shaped) or a convex shape. Additionally, at least one exterior side wall of a slider may include at least one rib, bulge, bump, knob, protrusion, distension, and/or protuberance to assist a user in gripping the slider. Illustratively, a gripping assist extending from a top portion of at least one side wall to a bottom portion thereof may be in any pattern, including, for example, horizontal, vertical, curved, serpentine, zigzag, and/or diagonal, to assist a user in gripping the slider. Combinations of the above gripping assists may also be used in the present invention.

In yet another embodiment of the present invention, at least one portion of a slider may be directed inwardly from a bottom portion of at least one side wall of the slider and/or from at least one interior portion of the slider for holding the slider on the closure assembly. Ribs may interconnect the side walls wherein the ribs form a lattice structure (see, for example, FIG. 3). At least one separator finger or leg may extend downwardly from at least one top portion of at least one rib of the slider and/or a central elongate rib running between a separating end and a closing end of the slider. At slider of the present invention may also have at least one closing bar that extends inwardly from at least one side wall.

In one embodiment, a lattice-like arrangement of ribs provides a plurality of openings or apertures in a slider (See, for example, FIGS. 2, 3, 6, 8, 11, 13, and 17), thereby giving the slider a hollow appearance and reducing the amount of material needed to construct or manufacture the slider. Illustratively, the slider has at least one top portion, with at least one top potion having a plurality of apertures. Alternatively, a plurality of apertures may be created from at least one top portion of the slider. The slider may also have two or more side walls depending from opposite sides of a top portion for receiving a closure assembly of the reclosable pouch therebetween. At least one guide member and/or at least one closing member may also extend inwardly from at least one of: (a) at least one inner wall of at least one of the side walls, or (b) at least one interior portion of the slider.

In yet another embodiment, a slider has a first guide member extends inwardly from an inner wall of a first side wall of the slider and a second guide member extends inwardly from an inner wall of a second side wall of the slider; and a first closing member extends inwardly from the inner wall of the first side wall of the slider and a second closing member extends inwardly from the inner wall of the second side wall the slider. In another embodiment, the first and second guide members are on opposite side walls of the slider, and in yet another embodiment, the first and second guide members are on the same side of the slider. In still another embodiment, the first and second closing members are on opposite side walls of the slider, while in yet another embodiment, the first and second closing members are on the same side of the slider. The slider may also include at least one foot extending inwardly from a bottom portion of at least one side wall and/or interior portion of the slider of the slider. The feet may be configured to engage the closure assembly to assist or prevent removal of the slider therefrom. The opening end of the slider may include a separating end portion that circumscribes the closure assembly creating a void defined between a majority of the separating end portion and the closure assembly. At least one separating finger may extend inward from a top portion of the separating end portion. At the top portion of the slider the plurality of apertures in one embodiment is a lattice-like arrangement comprising a plurality of ribs. The slider of the present invention may also contain at least one central elongate rib that extends along a length of a top of the slider, including, for example, extending partially the entire length of the slider from the opening end to the closing end or extending substantially the entire length of the slider from the opening end to the closing end. A plurality of ribs may in one embodiment extend transversely from at least one central elongate rib along the top portion. The slider of the present invention may also have at least one top portion, at least one bottom portion, and/or at least one side wall that are not planar.

In yet another embodiment of the present invention a slider for a reclosable pouch has a top portion with a lattice-like arrangement of ribs. A plurality of apertures is provided between the ribs, and two or more side walls depend from opposite sides of the top portion for receiving a closure assembly of the reclosable pouch therebetween. At least one of the side walls may include at least one concave portion or U-shaped side member, and a first guide member may extend inwardly from an inner wall of a first side wall and a second guide member may extend inwardly from an inner wall of a second side wall. A first closing member may also extend inwardly from an inner wall of a first side wall and a second closing member may extend inwardly from an inner wall of a second side wall. In one embodiment, two or more concave portions or U-shaped side member are on opposing sides of the slider. In yet another embodiment, the first closing member and the second closing member are on opposing sides of the slider. In another embodiment, at least one concave portion may extend inwardly partially or substantially the entire length of the slider between the opening and closing ends of the slider. Illustratively, the concave portion or U-shaped side member is formed to allow at least one finger of a user to engage therewith. A concave portion or U-shaped side member may include at least one rib extending thereacross. At least one rib on a concave portion of a first side wall may also extend across the top portion to a rib on the concave portion of a second side wall.

A slider of the present invention may also have a top portion having a lattice-like arrangement of ribs where a plurality of apertures are provided between the ribs; two or more side walls that depend from opposite sides of the top portion for receiving a closure assembly of the reclosable pouch therebetween; and at least one side wall that includes a discrete panel. A first guide member may extend inwardly from an inner wall of a first side wall and a second guide member may extend inwardly from an inner wall of a second side wall. A first closing member may also extend inwardly from an inner wall of a first side wall and a second closing member may extend inwardly from an inner wall of a second side wall. In one embodiment, the discrete panel may: (a) be disposed within a substantially central portion of the side wall, (b) be surrounded by a lattice-like arrangement of ribs, (c) be formed to allow at least one fingers of a user to engage therewith, and/or (d) include at least one rib extending thereacross. At least one rib on the discrete panel of a first side wall may also extend across the top portion to a rib on the discrete portion of a second side wall.

A reclosable pouch incorporating a slider of the present invention in one embodiment includes techniques for preventing the slider from sliding off the end of the pouch once the slider reaches the end of the pouch. Illustratively, the techniques for preventing the slider from sliding off the pouch includes, for example, crushing and/or fusing (for example, by heat, chemically, and/or ultrasonically fusing or welding plastic part together) a section of the closure assembly to form a stomp to prevent the slider from passing past the crushed or fused section. In one embodiment, such crushed or fused sections are proximate to the opened position and/or the closed position of the closure assembly.

Illustratively, as a slider of the present invention moves along a closure assembly from an open position to a closed position, the slider configures fastener strips and fastener mechanisms to an interlocked position so as to close a reclosable pouch opening or mouth. As the slider moves along the closure assembly from the closed position to the opened position, the slider configures at least one of the fastener strips and/or fastener mechanisms to an unlocked or disengaged position so as to allow access through the opening to the pouch interior. Stomps and/or stops adjacent to the ends of the fastener strips interfere with and prevent travel of the slider beyond the fastener strips.

A slider of the present invention may be constructed from, for example, multiple parts and joined together, and/or the parts may be constructed to be snapped together. Alternatively, the slider may be constructed from one piece. The slider may be made using any desired method known to those skilled in the art, including, for example, injection molding. A slider of the present invention may be made from any suitable material including, for example, metal, ceramic, glass, rubber, and/or a polymer or a plastic such, for example, nylon, polypropylene, polystyrene, acetal, toughened acetal, polyketone, polybutylene terephthalate, high density polyethylene, polycarbonate, and/or ABS, and combinations thereof.

A reclosable pouch useful in the present invention may be made by various techniques known to those skilled in the art including those described in, for example, Geiger, et al., U.S. Pat. No. 4,755,248. Other useful techniques to make a reclosable pouch of the present invention include those described in, for example, Zieke et al., U.S. Pat. No. 4,741,789. Other useful techniques to make a reclosable pouch of the present invention include those described in, for example, Porchia et al., U.S. Pat. No. 5,012,561. Examples of making a reclosable thermoplastic pouch as described herein include, for example, a cast post applied process, a cast integral process, and/or a blown process. Illustratively, a reclosable pouch wall of the present invention may be made of any flexible material suitable for packaging a sample, article, and/or substance, including, for example, any suitable thermoplastic film. A flexible material useful in the present invention includes, for example, polyethylene (for example, low density polyethylene, and linear low density polyethylene), substantially linear copolymers of ethylene and a $C_3$–$C_8$ alpha-olefin, polypropylene, polyvinylidene chloride, polyvinyl chloride, vinyl, and/or other polymers, in single or multiple layer, and combinations thereof. Additionally, the reclosable pouch wall may be constructed of paper and/or a flexible metal, including, for example, aluminum foil or sheets. The flexible material may be transparent or semi-transparent (to permit viewing of the sample, article, and/or substance in the reclosable pouch), translucent, lucent, clear, and/or opaque, at least in part, depending on the application in which the reclosable pouch will be utilized.

In yet another aspect, the present invention provides a kit comprised of a slider and a reclosable pouch. The slider of a kit may, for example, be configured to attach to a closure assembly by snapping at least on piece of the slider together on a closure assembly disposed on the reclosable pouch. Alternatively, the slider of a kit may, for example, be one piece that is slid onto one end of closure assembly of this reclosable pouch and then, in one embodiment, at least one of the ends of the closure assembly are closed, crushed, and/or fused to form at least one stop or stomp to prevent the slider from passing past the closed, crushed, and/or fused section. The kit may also include a set of instructions to instruct a user how to assemble and/or use the kit.

It is also contemplated that more than one slider of the present invention can be used on a closure assembly and/or a reclosable pouch.

Although the embodiments shown herein illustrate a reclosable pouch opening, closure assembly and/or associated structures at an upper end or top of the reclosable pouch, the present invention is intended to cover other arrangements in which, for example, the pouch opening, closure assembly and/or associated structures are provided on at least one side of the reclosable pouch and/or on at least one bottom portions of a pouch.

INDUSTRIAL APPLICABILITY

The present invention provides apparatuses, methods, kits, and combinations, useful for opening and/or closing a pouch with a sliding closure assembly. For example, the present invention provides sliders exhibiting improved performance as closure mechanisms including, for example, improved performance in opening and/or closing a reclosable pouch, and/or retaining the position of the slider on a closure assembly. The sliding closure assemblies of the present invention also exhibit improved ease of use, while reducing and/or minimizing the amount of material required to make or produce a slider assembly.

The invention has been described in an illustrative manner, and it is to be understood that the terminology used is intended to be in the nature of description rather than of limitation. All patents and other references cited herein are incorporated by reference in their entirety. Many modifications, equivalents, and variations of the present invention are possible in light of the above teachings, therefore, it is to be understood that within the scope of the appended claims, the invention may be practiced other than as specifically described.

What is claimed is:

1. A slider for a reclosable pouch, comprising:

a top portion comprising a plurality of ribs and a plurality of apertures;

at least two side walls depending from opposite sides of the top portion for receiving a closure assembly of the reclosable pouch therebetween;

at least one guide member extending inwardly from at least one of the side walls and at least one of an interior portion of the slider;

at least one closing member extending inwardly from at least one of an inner wall of the side wall and the interior portion of the slider;

at least one elongate rib spaced between the at least two side walls that extends from an opening end to a closing end of the slider, and wherein the plurality of ribs extends transversely from the at least one elongate rib along the top portion to the at least two side walls.

2. The slider of claim 1, wherein a first guide member extends inwardly from an inner wall of a first side wall and a second guide member extends inwardly from an inner wall of a second side wall; and a first closing member extends inwardly from the inner wall of the first side wall and a second closing member extends inwardly from the inner wall of the second side wall.

3. The slider of claim 1, wherein an opening end of the slider includes a separating end portion that circumscribes the closure assembly, and wherein a void is defined between a majority of the separating end portion and the closure assembly.

4. The slider of claim 3, wherein a separating finger extends inwardly from a top portion of the separating end portion.

5. The slider of claim 1, wherein at least one of the top portions and bottom portions is not planar.

6. The slider of claim 1, wherein at least one of the side walls is not planar.

7. A slider for a reclosable pouch, comprising:

a top portion comprising an arrangement of ribs wherein a plurality of apertures is provided between the ribs;

at least two side walls depending from opposite sides of the top portion for receiving a closure assembly of the reclosable pouch therebetween, and wherein at least one of the side walls optionally includes a concave portion;

at least one guide member extending inwardly from at least one of the side walls and at least one of en interior portion of the slider;

at least one closing member extending inwardly from at least one of an inner wall of the side wall and the interior portion of the slider;

at least one elongate rib spaced between the at least two side walls that extends from an opening end to a closing end of the slider; and wherein the arrangement of ribs extends from the at least one elongate rib along the top portion to the at least two side walls.

8. The slider of claim 7, wherein the optional concave portion extends inwardly between an opening end and a closing end of the slider.

9. The slider of claim 8, wherein the concave portion is configured to allow at least one finger of a user to engage therewith.

10. The slider of claim 9, wherein the concave portion includes at least one gripping assist.

11. The slider of claim 7, wherein the slider comprises two concave portions disposed on opposing sides of the slider.

12. A slider for a reclosable pouch, comprising:

a top portion comprising an arrangement of ribs wherein a plurality of apertures is provided between the ribs;

two or more side walls depending from opposite sides of the top portion for receiving a closure assembly of the reclosable pouch therebetween, and wherein at least one of the side walls includes a discrete panel comprising an arrangement of ribs disposed on an exterior surface thereof;

at least one guide member extending inwardly from at least one of the side walls and at least one of an interior portion of the slider;

at least one closing member extending inwardly from at least one of an inner wall of the side wall and the interior portion of the slider;

at least one elongate rib spaced between the two or more side walls that extends from an opening end to a closing end of the slider; and wherein the arrangement of ribs extends from the at least one elongate rib along the top portion to the at least two side walls.

13. The slider of claim 12, wherein the discrete panel is disposed within a central portion of the side wall.

14. The slider of claim 12, wherein the discrete panel is configured to allow at least one finger of a user to engage therewith.

15. The slider of claim 12, wherein the discrete panel includes at least one gripping assist extending thereacross.

16. The slider of claim 12, wherein the slider has two discrete panels disposed on opposing sides of the slider, the discrete panels comprising at least one gripping assist comprised of a ridge, wherein at least one ridge further extends across the top portion of the slider.

17. The slider of claim 1 further comprising a plurality of apertures disposed between the central elongate rib and at least one of the at least two side walls.

18. The slider of claim 1, wherein at least one of the opening end or the closing end has an annular shape.

19. The slider of claim 1, wherein the separating finger extends inwardly from the at least one elongate rib.

20. The slider of claim 1 further comprising a second guide member, wherein the first guide member and the second guide member form a channel therebetween, and wherein the first guide member and the second guide member extend from the opening end to the closing end of the slider.

* * * * *

UNITED STATES PATENT AND TRADEMARK OFFICE

CERTIFICATE OF CORRECTION

PATENT NO. : 7,188,394 B2
APPLICATION NO. : 11/047007
DATED : March 13, 2007
INVENTOR(S) : Robert R. Turvey and Bryan L. Ackerman It is certified that error appears in the above-identified patent and that said Letters Patent is hereby corrected as shown below:

Column 12: Line 40, replace “en” with --an--

Signed and Sealed this

Nineteenth Day of August, 2008

JON W. DUDAS
*Director of the United States Patent and Trademark Office*